United States Patent [19]

Daar et al.

[11] Patent Number: 4,960,421

[45] Date of Patent: Oct. 2, 1990

[54] DEPILATORY DEVICE

[76] Inventors: Yair Daar, Moshav Galia; Shimon Yahav, 61 Remez Street, Rehovot, both of Israel

[21] Appl. No.: 297,832

[22] Filed: Jan. 17, 1989

[30] Foreign Application Priority Data

Feb. 22, 1988 [IL] Israel ..... 85501
Dec. 6, 1988 [IL] Israel ..... 88609

[51] Int. Cl.[5] ..... A61B 17/00
[52] U.S. Cl. ..... 606/133
[58] Field of Search ..... 128/355, 354; 17/11.1 R, 47; 606/133

[56] References Cited

U.S. PATENT DOCUMENTS

| | | | |
|---|---|---|---|
| 1,232,617 | 7/1917 | Shipp | 128/355 |
| 1,743,590 | 1/1930 | Binz . | |
| 2,083,380 | 6/1937 | Hudson | 128/355 |
| 2,458,911 | 1/1949 | Kerr | 128/354 |
| 2,486,616 | 11/1949 | Schulbiger | 128/354 |
| 2,592,484 | 4/1952 | Smith | 128/354 |
| 2,900,661 | 3/1957 | Schnell | 17/11.1 |
| 3,613,690 | 10/1971 | Newell | 128/355 |
| 4,079,741 | 3/1978 | Daar et al. | 128/355 |
| 4,171,701 | 10/1979 | Walter | 128/354 |
| 4,279,253 | 7/1981 | Haes et al. | 128/355 |
| 4,524,772 | 6/1985 | Daar et al. | 128/355 |
| 4,726,375 | 2/1988 | Gross et al. | 128/355 |
| 4,807,624 | 2/1989 | Gross et al. | 128/355 |

FOREIGN PATENT DOCUMENTS

| | | | |
|---|---|---|---|
| 2650969 | 6/1977 | Fed. Rep. of Germany . | |
| 2307491 | 11/1976 | France . | |
| 2454283 | 11/1980 | France . | |
| 2556939 | 6/1985 | France . | |
| 61702 | 10/1978 | Greece . | |
| 179261 | 12/1935 | Switzerland | 128/355 |
| 268696 | 5/1950 | Switzerland . | |
| 225445 | 12/1924 | United Kingdom | 128/355 |

*Primary Examiner*—Michael H. Thaler
*Attorney, Agent, or Firm*—Helfgott & Karas

[57] ABSTRACT

A depilatory device comprising a hand-held portable housing, motor apparatus disposed in the housing; first and second helical springs arranged to be driven by the motor apparatus in rotational sliding motion relative to skin bearing hair to be removed, the first and second helical springs each including an arcuate hair engaging portion arranged to define a convex side at which the windings are spread apart and a concave side corresponding thereto at which the windings are pressed together, the rotational motion of the helical spring producing continuous motion of the windings from a spread-apart orientation at the convex side to a pressed together orientation at the concave side for engagement and plucking of hair from the skin.

12 Claims, 15 Drawing Sheets

DEPILATORY DEVICE

FIELD OF THE INVENTION

The present invention relates to depilatory apparatus and more particularly to electrically powered depilatory apparatus.

BACKGROUND OF THE INVENTION

Various types of depilatory apparatus are known in the art. One type of manually operated device, exemplified in Swiss Patent No. 268,696 and U.S. Pat. Nos. 2,458,911, 2,486,616 and 1,743,590 employs a coil spring which engages hairs in spaces between the convolutions thereof and pulls the hair away from the skin as the spaces between the convolutions are closed. The operation of this type of device is highly inefficient, slow and painful.

Early power driven depilatory devices are exemplified in U.S. Pat. No. 4,079,741 of present Applicants. U.S. Pat. No. 4,079,741 describes a hair plucking device employing an axially disposed helical spring which is simultaneously driven in axial rotation by an electric motor and reciprocatingly compressed and extended by a cam operated by the electric motor. This apparatus is relatively complex and costly and has not reached the market.

A highly successful power driven depilatory device is described in Applicant's U.S. Pat. No. 4,524,772 which shows an electrically powered depilatory device including a hand-held portable housing, motor apparatus disposed in the housing and a helical spring comprising a plurality of adjacent windings arranged to be driven by the motor apparatus in rotational sliding motion relative to skin bearing hair to be removed, the helical spring including an arcuate hair engaging portion arranged to define a convex side whereat the winding are spread apart and a concave side corresponding thereto whereat the windings are pressed together, the rotational motion of the helical spring producing continuous motion of the winding from a spread-apart orientation at the convex side to a pressed together orientation at the concave side and for engagement and plucking of hair from the skin, whereby the surface velocities of the winding relative to the hair greatly exceeds the surface velocity of the housing relative thereto.

SUMMARY OF THE INVENTION

The present invention seeks to provide a depilatory device which, while being within the overall scope of Applicant's U.S. Pat. No. 4,524,772, contains additional features not taught therein.

There is thus provided in accordance with a preferred embodiment of the present invention a depilatory device comprising a hand-held portable housing, motor apparatus disposed in the housing; first and second helical springs arranged to be driven by the motor apparatus in rotational sliding motion relative to skin bearing hair to be removed, the first and second helical springs each including an arcuate hair engaging portion arranged to define a convex side at which the windings are spread apart and a concave side corresponding thereto at which the windings are pressed together, the rotational motion of the helical spring producing continuous motion of the windings from a spread-apart orientation at the convex side to a pressed together orientation at the concave side for engagement and plucking of hair from the skin. The term "helical spring" as used throughout extends to any resilient body formed of any suitable material arranged in a bent or bowed configuration, having openings which open and close as the body is rotated. Thus, for example, both a body formed by winding of an elongate element and a body having continuous or intermittent slits formed therein fall within the definition of "helical spring".

In accordance with one embodiment of the invention, the first and second springs are arranged in a generally co-planar orientation. One preferred orientation is a spread-apart orientation, while another preferred orientation is a parallel orientation.

There is also provided in accordance with a preferred embodiment of the present invention a depilatory device comprising a hand-held portable housing, motor apparatus disposed in the housing; at least one helical spring arranged to be driven by the motor apparatus in rotational sliding motion relative to skin bearing hair to be removed, the at least one helical spring including an arcuate hair engaging portion arranged to define a convex side at which the windings are spread-apart and a concave side corresponding thereto at which the windings are pressed together, the rotational motion of the helical spring producing continuous motion of the windings from a spread-apart orientation at the convex side to a pressed together orientation at the concave side for engagement and plucking of hair from the skin, and apparatus for varying the orientation of the arcuate hair engaging portion.

Further in accordance with a preferred embodiment of the present invention, the first and second helical springs are driven in opposite directions of rotation.

Additionally, in accordance with a preferred embodiment of the invention, the first and second helical springs may be arranged such that they lie generally in a single plane.

In accordance with an alternative embodiment of the invention, the first and second helical springs may be arranged such that they lie generally in parallel planes.

In accordance with one embodiment of the invention, a stiffening spring is associated with each of the first and second helical springs.

In accordance with an alternative embodiment of the invention no stiffening spring is associated with either of the first and second helical springs.

In accordance with an embodiment of the invention, apparatus is provided for varying the orientations of the arcuate portions of the first and second helical springs.

In accordance with an embodiment of the invention, which does not employ a stiffening spring, mounting pins are fixed in said housing for rotatable mounting of the first and second helical springs at their respective ends.

Additionally in accordance with the foregoing embodiment of the invention, the first and second helical springs are removably mounted in the housing.

BRIEF DESCRIPTION OF THE DRAWINGS

The present invention will be understood and appreciated more fully from the following detailed description in which.

DETAILED DESCRIPTION OF A PREFERRED EMBODIMENT

Figure 1A:
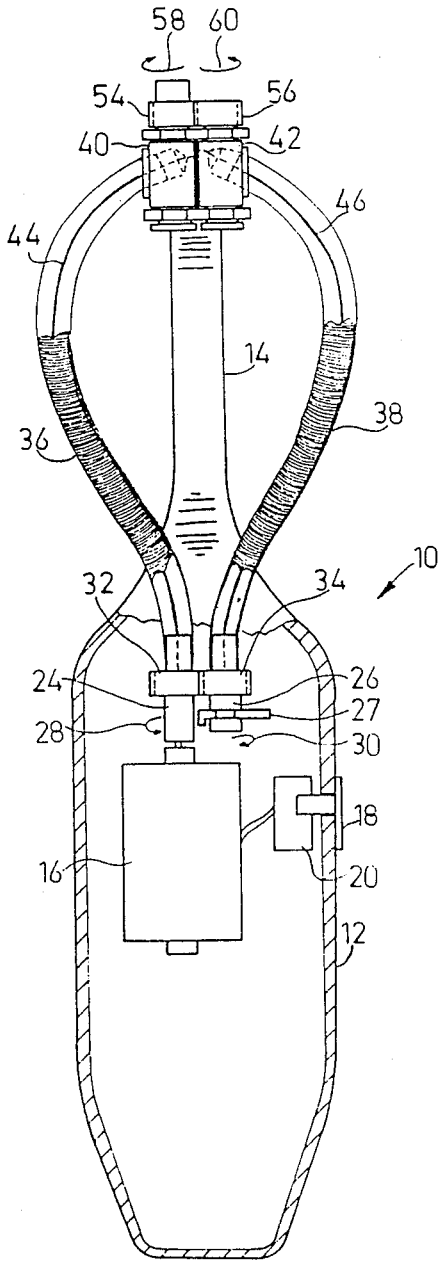
FIGS. 1A and 1B are sectional illustrations of a depilatory device constructed and operative in accordance with a preferred embodiment of the present invention, taken in perpendicular planes.
Figure 1B:
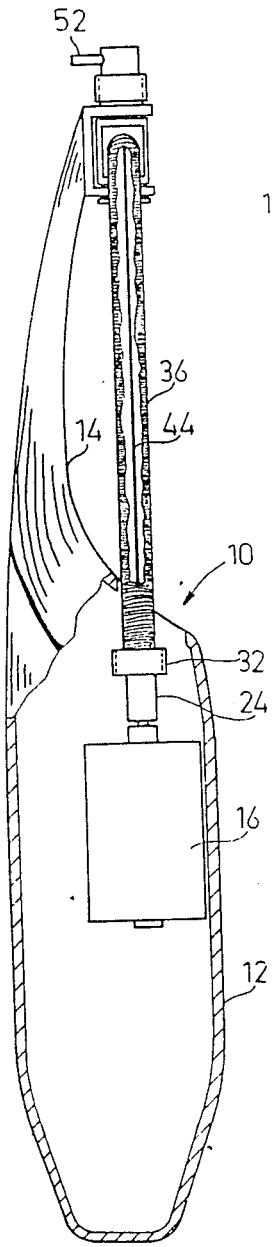
Figure 1C:
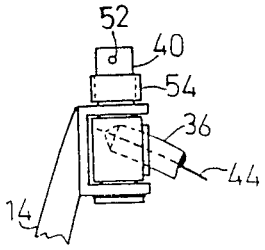
FIG. 1C is a detailed illustration of the engagement of one end of the elongate spring with the housing.
Figure 2A:
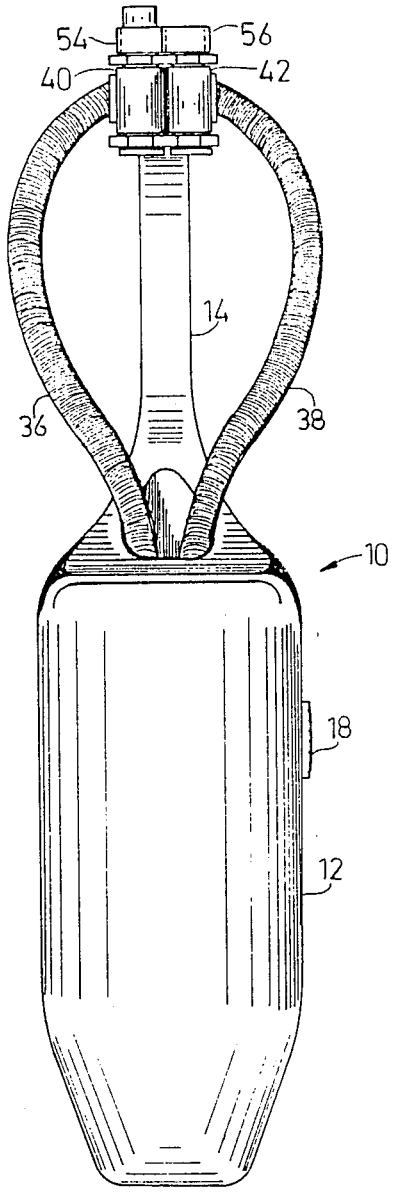
FIGS. 2A and 2B are respective underside views of the depilatory device of FIGS. 1A–1C in respective first and second operative orientations.
Figure 2B:
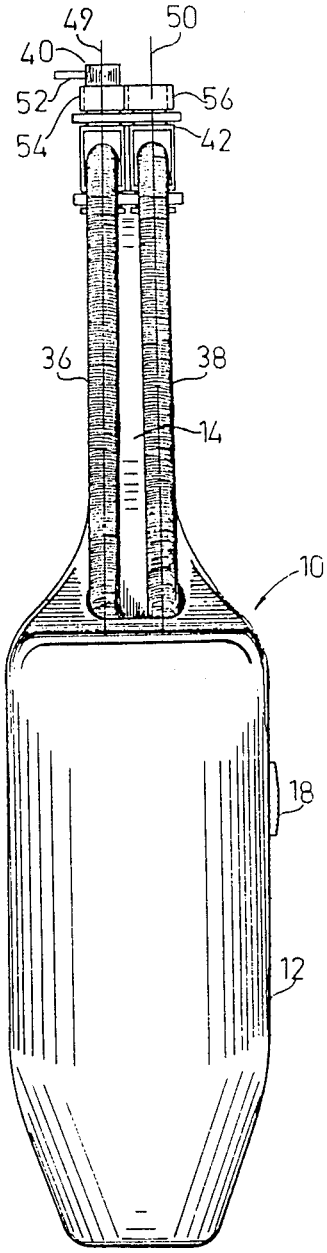
Figure 3A:
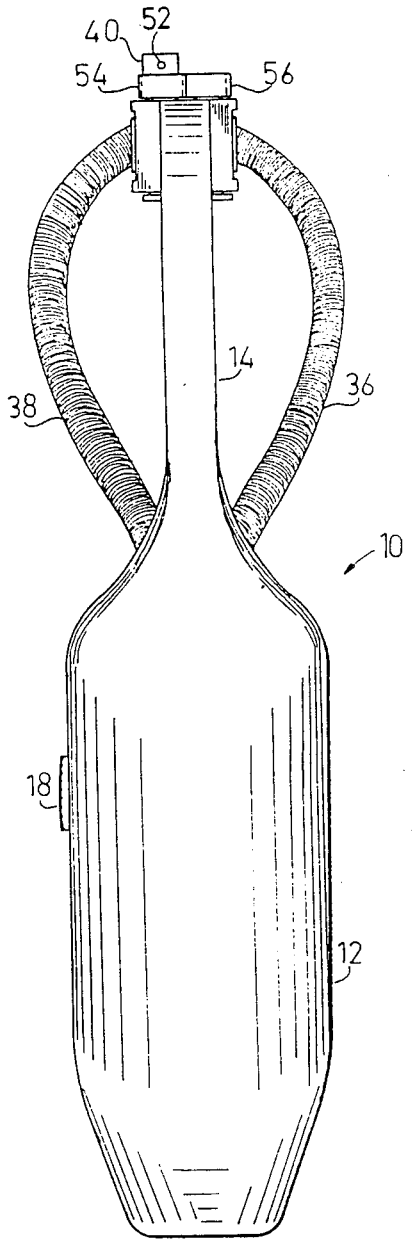
FIGS. 3A and 3B are respective top views of the depilatory device of FIGS. 1A–1C in the respective first and second operative orientations.
Figure 3B:
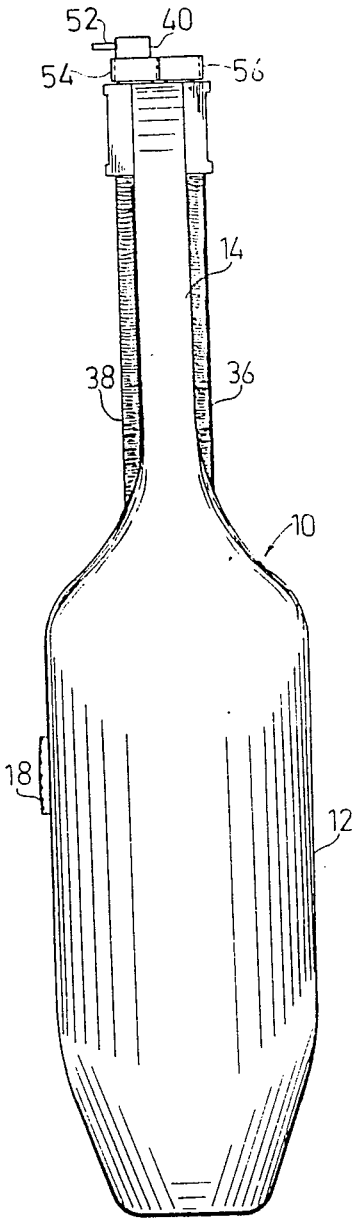

Reference is now made to FIGS. 1A–4B, which illustrate depilatory apparatus comprising a housing 10, typically formed of an impact resistant plastic material, which housing is configurated to be hand-held in use. The housing 10 defines a body portion 12 which is typically integrally formed with an operating head support portion 14. According to an alternative embodiment of the present invention, the operating head support portion 14 may be removably attached to the body portion 12.

Mounted interiorly of the body portion 12 of housing 10 is an electric motor 16. The operation of motor 16 is controlled by a manually operable switch plate 18 which is disposed outside of housing 10 and connected to a switch 20 associated with motor 16.

Motor 16 drives first and second spindles 24 and 26 in rotation in respective opposite directions, typically indicated by arrows 28 and 30 respectively. Spindle 24 is directly coupled to the motor 16 and roates in the same direction as does the motor output shaft. Spindle 26 is coupled to spindle 24 by means of gears 32 and 34, integrally formed with spindles 24 and 26 respectively, producing rotation of spindle 26 in a rotational direction opposite to that of spindle 24. Spindle 26 is rotatably supported by a retaining element 27 which may be integrally formed with housing body portion 12.

Mounted on respective spindles 24 and 26 for rotation together therewith are first ends of first and second generally elongate helical springs 36 and 38. The opposite ends of the springs 36 and 38 are rotatably seated in, but not fixed to, respective rotatable supports 40 and 42 which are rotatably mounted onto support portion 14.

Stiffening wires 44 and 46 extend through respective helical springs 36 and 38 for maintaining the springs in predetermined arcuate orientation, typically as illustrated. Stiffening wires 44 and 46 are mounted at one end on spindles 24 and 26 respectively and at their opposite end onto respective rotatable supports 40 and 42.

Figure 4A:
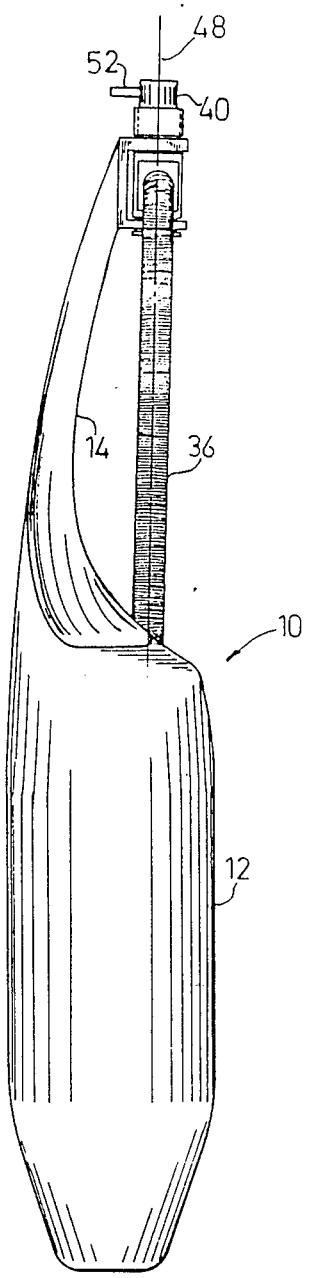
FIGS. 4A and 4B are respective side view illustrations of the depilatory device of FIGS. 1A–1C in the respective first and second operative orientations.
Figure 4B:
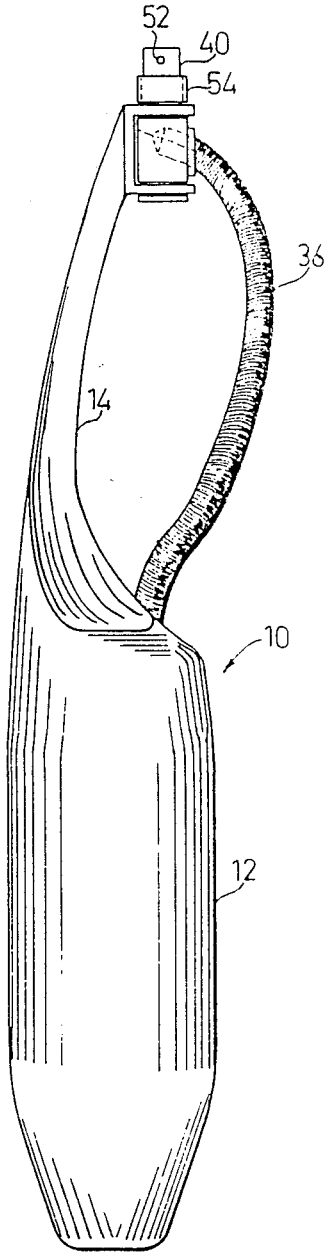

In accordance with a preferred embodiment of the present invention, means are provided for selectably determining the planar orientation of the springs 36 and 38 and enabling this orientation to be varied between the two extremes illustrated in the drawings. In one extreme orientation, illustrated in FIGS. 1A, 1B, 2A, 3A and 4A, the springs 36 and 38 are spread apart, such that the arcuate portions of both springs lie generally in a single plane 48 (FIG. 4A). In the other extreme orientation, illustrated in FIGS. 2B, 3B and 4B, the springs 36 and 38 lie in adjacent relationship in generally parallel planes 49 and 50, generally perpendicular to the single plane 48 mentioned above in connection with FIGS. 1A, 1B, 2A, 3A and 4A.

The apparatus for selectably varying the orientation of the springs 36 and 38 typically comprises a lever 52 (FIG. 1B), which may be integrally formed with support 40. Supports 40 and 42 are typically integrally formed with gear portions 54 and 56 which interdigitate such that rotational motion of support 40 in a first direction, e.g. as illustrated by an arrow 58, produces rotational motion of support 42 in an opposite direction, such as illustrated by an arrow 60.

Reference is now made to FIGS. 5–11, which illustrate an alternative embodiment of depilatory device constructed and operative in accordance with a preferred embodiment of the invention and which is characterized in that it does not require a stiffening wire to be associated with the springs.

The depilatory apparatus comprises a housing 70, typically formed of an impact resistant plastic material, which housing is configured to be hand-held in use. The housing 70 defines a body portion 72 which is typically integrally formed with an operating head support portion 74.

Figure 6:
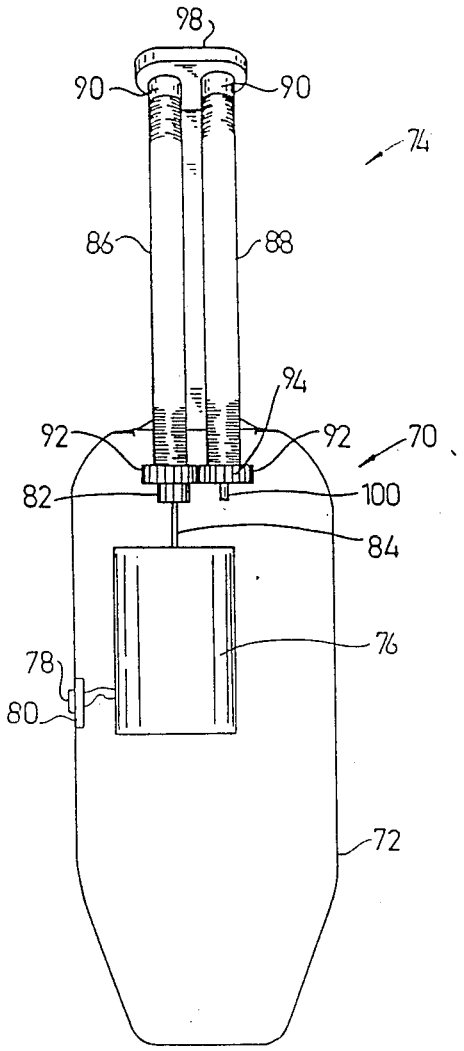
FIG. 6 is a front view of the interior of the depilatory device of FIG. 5.
Figure 7:
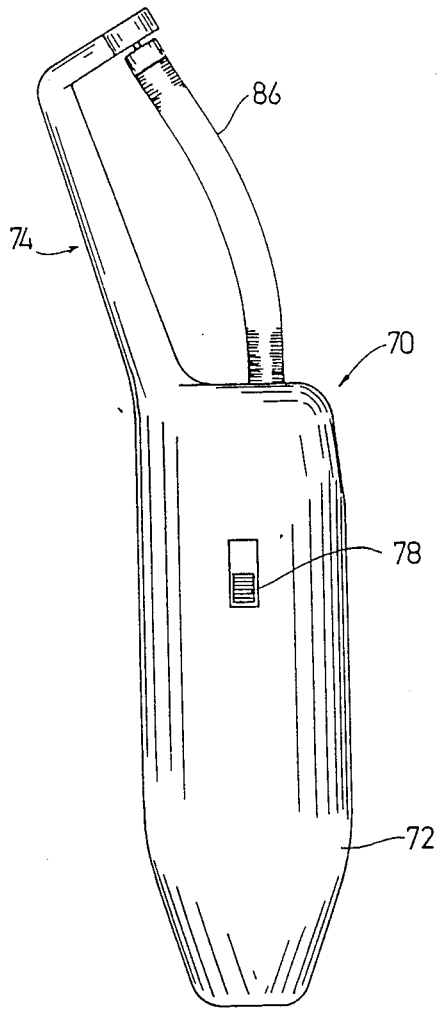
FIG. 7 is a side view of the exterior of the depilatory device of FIGS. 5 and 6.
Figure 8:
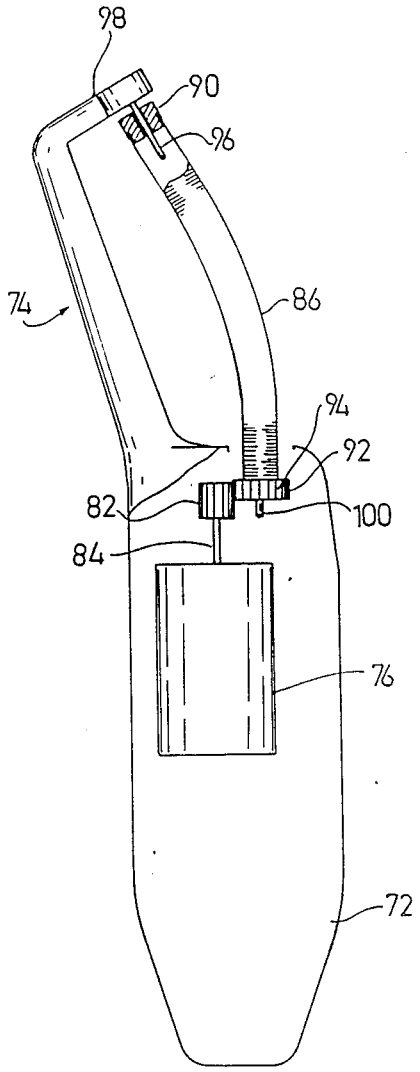
FIG. 8 is a side view of the interior of the depilatory device of FIGS. 5–7.
Figure 9:
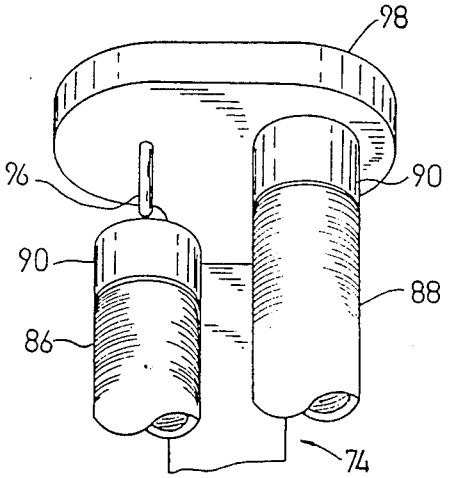
FIG. 9 is a pictorial illustration of the removable engagement of helical springs at a non driven end thereof with the housing of the depilatory device in the embodiment of FIGS. 5–8.
Figure 10:
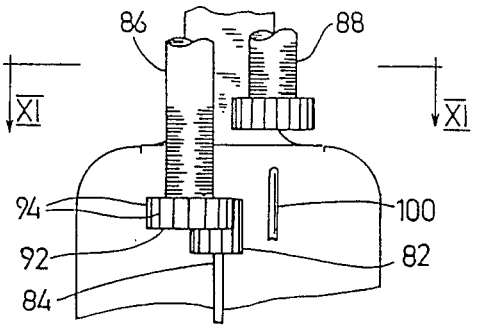
FIG. 10 is a pictorial illustration of the removable engagement of helical springs at a driven end thereof with the housing of the depilatory device in the embodiment of FIGS. 5–9.

Mounted interiorly of the body portion 72 of housing 70 is an electric motor 76 (FIG. 6). The operation of motor 76 is controlled by a manually operable switch plate 78 which is disposed outside of housing 70 and connected to a switch 80 associated with motor 76. Motor 76 drives a gear 82, which is fixedly mounted onto the shaft 84 of motor 76.

First and second generally elongate helical springs 86 and 88 are fixedly attached at one end thereof to centrally apertured rotatable end members 90 and at an opposite thereof to apertured end members 92 having gear teeth 94 on their cylindrical edge surfaces.

Helical springs 86 and 88 are rotatably mounted onto housing 70 by means of mounting pins 96 (FIG. 8) which are fixedly located at an extreme end 98 of head support portion 74 and by means of mounting pins 100 which are fixedly located in housing 70, as illustrated. Mounting pins 96 each rotatably engage an aperture formed in a respective rotatable end member 90 while mounting pins 100 each rotatably engage an aperture formed in a respective rotatable end member 92.

Figure 11:
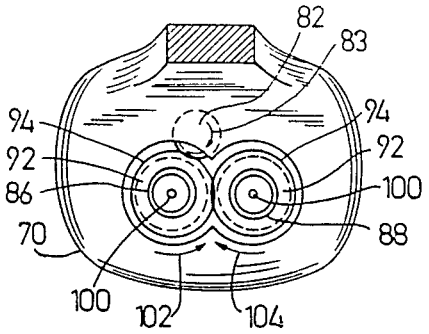
FIG. 11 is a sectional illustration of the engagement shown in FIG. 10, taken along the lines XI—XI in FIG. 10.

As seen particularly in FIG. 11, the arrangement of pins 100 is such that the gear teeth of end members 92 are drivingly engaged and that the gear teeth of one of end members 92 are drivingly engaged by gear 82 and is driven in the direction indicated by arrow 83. In this way, springs 86 and 88 are driven in respective opposite directions, as indicated by arrows 102 and 104.

It is a particular feature of the embodiment of FIGS. 5–11 that the provision of stiffening wires as in other embodiments is not necessary for maintaining the springs in predetermined arcuate orientation, typically as illustrated. Furthermore, if desired, the springs 86 and 88 and associated end members may be arranged for easy removal and replacement.

It will be appreciated that similarly to the operation of the device taught in U.S. Pat. No. 4,524,772, the arcuate hair engaging portion of each of the springs is arranged to define a convex side whereat the windings are spread apart and a concave side corresponding thereto whereat the windings are pressed together, the rotational motion of the helical spring producing continuous motion of the windings from a spread-apart orientation at the convex side to a pressed together orientation at the concave side and for engagement and plucking of hair from the skin.

The particular advantages of the structure described hereinabove include the ability of the device to provide efficient depilation of hair growing in various directions in narrow places and the ability to efficiently depilate a flat surface.

Figure 12:
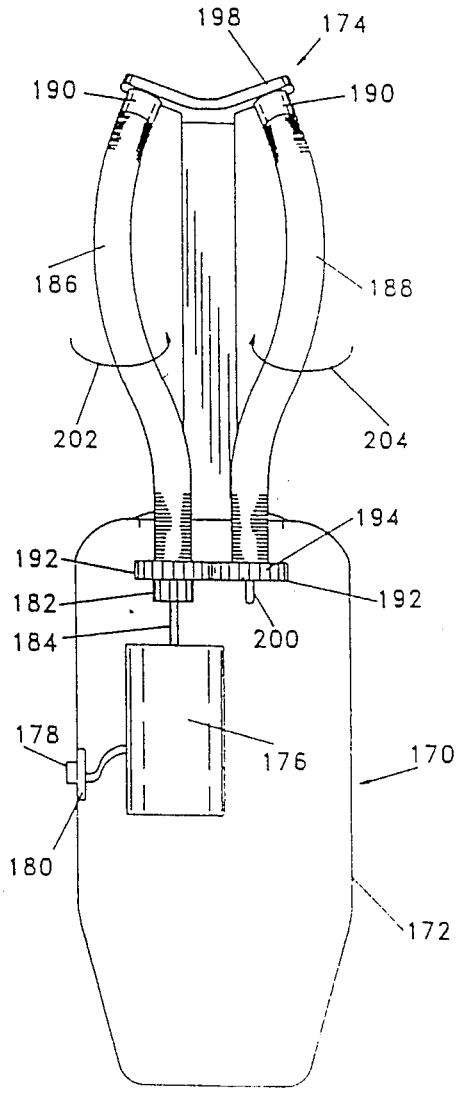
FIG. 12 is a cut away front view of a depilatory device constructed and operative in accordance with an additional embodiment of the invention.
Figure 13:
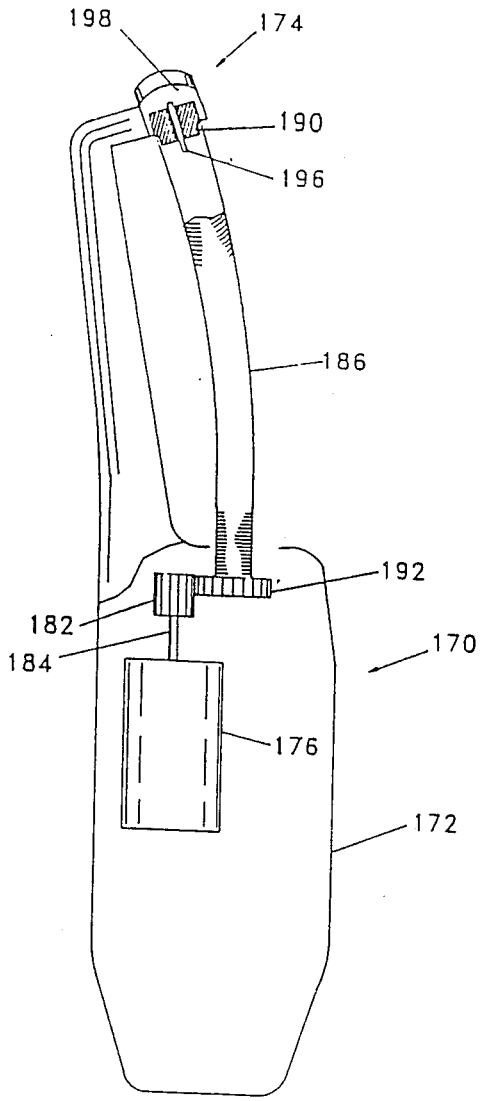
FIG. 13 is a cut away side view corresponding to the front view of FIG. 12.

Reference is now made to FIGS. 12 and 13, which illustrate an alternative embodiment of depilatory device which similarly to the embodiment of FIGS. 5–11 is characterized in that it does not require a stiffening wire to be associated with the springs.

The depilatory apparatus comprises a housing 170, typically formed of an impact resistant plastic material, which housing is configured to be hand-held in use. The housing 170 defines a body portion 172 which is typically integrally formed with an operating head support portion 174.

Mounted interiorly of the body portion 172 of housing 170 is an electric motor 176. The operation of motor 176 is controlled by a manually operable switch plate 178 which is disposed outside of housing 170 and connected to a switch 180 associated with motor 176. Motor 176 drives a gear 182, which is fixedly mounted onto the shaft 184 of motor 176.

First and second generally elongate helical springs 186 and 188 are fixedly attached at one end thereof to centrally apertured rotatable end members 190 and at an opposite thereof to apertured end members 192 having gear teeth 194 on their cylindrical edge surfaces.

Helical springs 186 and 188 are rotatably mounted onto housing 170 by means of mounting pins 196 (FIG. 13) which are fixedly located at an extreme end 198 of head support portion 174 and by means of mounting pins 200 which are fixedly located in housing 170, as illustrated. Mounting pins 196 each rotatably engage an aperture formed in a respective rotatable end member 190 while mounting pins 200 each rotatably engage an aperture formed in a respective rotatable end member 192.

As seen particularly in FIG. 12, the arrangement of pins 200 is such that the gear teeth of end members 192 are drivingly engaged and that the gear teeth of one of end members 192 are drivingly engaged by gear 182. In this way, springs 186 and 188 are driven in respective opposite directions, as indicated by arrows 202 and 204.

As in the embodiment of FIGS. 5–11, the provision of stiffening wires is not necessary for maintaining the springs in predetermined arcuate orientation. The springs 186 and 188 and associated end members may be arranged for easy removal and replacement.

Figure 5:
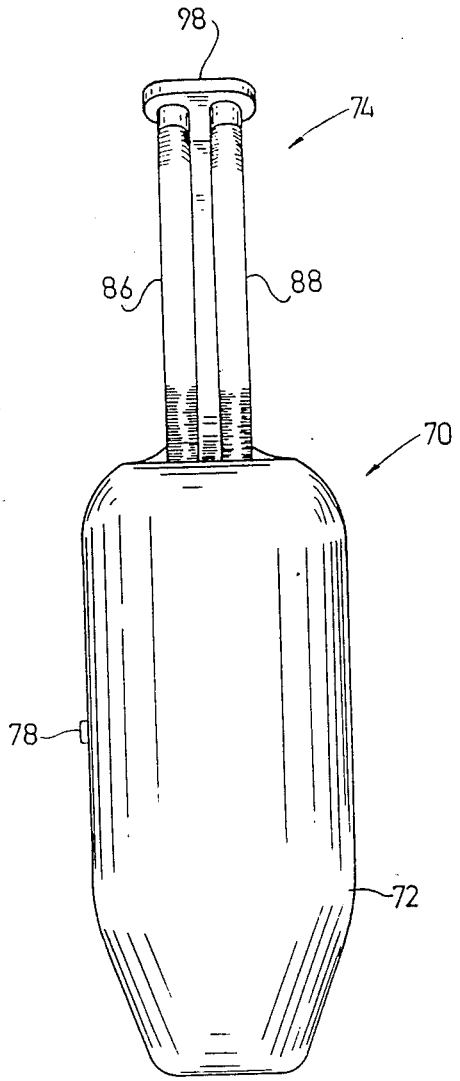
FIG. 5 is a front view of the exterior of a depilatory device constructed and operative in accordance with an additional embodiment of the invention.

As distinct from the embodiment of FIGS. 5–11 in which the springs 86 and 88 are in a generally parallel orientation as seen best in FIGS. 5 and 6, in the embodiment of FIGS. 12 and 13 the springs 186 and 188 are arranged in a spread-apart, generally coplanar orientation. It is noted that springs 186 and 188 do not lie in a flat plane, but rather in a somewhat curved plane, as can be appreciated from a consideration of FIG. 13.

It will be appreciated by persons skilled in the art that the present invention is not limited by what has been particularly shown and described hereinabove. Rather the scope of the present invention is defined only by the claims which follow.

We claim:

1. A depilatory device comprising:

a hand-held portable housing;

motor means disposed in said housing;

first and second helical springs arranged to be driven by said motor means in rotational sliding motion relative to skin bearing hair to be removed, said first and second helical springs each including an arcuate hair engaging portion arranged to define a convex side at which the windings of the spring are spread apart and a concave side corresponding thereto at which said windings are pressed together, said rotational motion of said helical spring producing continuous motion of said windings from a spread-apart orientation at said convex side to a pressed together orientation at said concave side for engagement and plucking of hair from the skin;

means for rotatably mounting said first and second helical springs relative to said housing, whereby the orientations of the first and second helical springs may be varied between a first extreme orientation wherein the first and second helical springs are spread apart, such that the arcuate portions thereof lie generally in a single plane and a second extreme orientation wherein the first and second helical springs lie in adjacent relationship in generally parallel planes, generally perpendicular to said single plane.

2. A depilatory device according to claim 1 and wherein said first and second helical springs are driven in opposite directions of rotation.

3. A depilatory device according to claim 1 and also comprising a stiffening spring associated with each of said first and second helical springs.

4. A depilatory device according to claim 1 and wherein no stiffening spring is associated with either of said first or second helical springs.

5. A depilatory device according to claim 4 and also comprising mounting pins fixed in said housing for rotatable mounting of said first and second helical springs at their respective ends.

6. A depilatory device according to claim 4 and wherein said first and second helical springs are removably mounted in said housing.

7. A depilatory device comprising:

a hand-held portable housing;

motor means disposed in said housing;

at least one helical spring arranged to be driven by said motor means in rotational sliding motion relative to skin bearing hair to be removed, said at least one helical spring including an arcuate hair engaging portion arranged to define a convex side at which the windings of the spring are spread apart and a concave side corresponding thereto at which said windings are pressed together, said rotation motion of said helical spring producing continuous motion of said windings from a spread-apart orientation at said convex side to a pressed together orientation at said concave side for engagement and plucking of hair from the skin; and means for varying the orientation of said at least one helical spring relative to said housing, whereby the orientation of the at least one helical spring may be varied between a first extreme orientation wherein the arcuate portion thereof lies generally in a first plane and a second extreme orientation wherein the at least one helical spring lies in a second plane, generally perpendicular to said first plane.

8. A depilatory device according to claim 7 and wherein said at least one helical spring may be arranged such that it lies at a selectable orientation.

9. A depilatory device according to claim 7 and also comprising a stiffening spring associated with said at least one helical spring.

10. A depilatory device according to claim 7 and wherein no stiffening spring is associated with said at least one helical spring.

11. A depilatory device according to claim 10 and also comprising at least one mounting pin fixed in said housing for rotatable mounting of said at least one helical spring.

12. A depilatory device according to claim 10 and wherein said at least one helical spring is removably mounted in said housing.

* * * * *